US007152595B1

(12) United States Patent
Muhich

(10) Patent No.: US 7,152,595 B1
(45) Date of Patent: Dec. 26, 2006

(54) BRACE FOR HOLDING ARCHERY BOW

(76) Inventor: Anthony J. Muhich, 2211 Brookwood Ct., Joliet, IL (US) 60435

( * ) Notice: Subject to any disclaimer, the term of this patent is extended or adjusted under 35 U.S.C. 154(b) by 20 days.

(21) Appl. No.: 11/004,118

(22) Filed: Dec. 2, 2004

(51) Int. Cl.
*F41B 5/00* (2006.01)

(52) U.S. Cl. ..... 124/86; 124/23.1

(58) Field of Classification Search ..... 124/23.1, 124/25.6, 86, 88; 248/354.5
See application file for complete search history.

(56) References Cited

U.S. PATENT DOCUMENTS 4,674,472 A * 6/1987 Reis ..... 124/89
5,201,488 A * 4/1993 Hadbavny ..... 248/354.5
5,243,957 A * 9/1993 Neilson ..... 124/88
5,555,874 A * 9/1996 Savage ..... 124/1
5,730,341 A * 3/1998 Hester, Jr. ..... 224/257
5,816,461 A * 10/1998 Balcom ..... 224/269
6,070,569 A * 6/2000 Chalin et al. ..... 124/86
6,173,707 B1 * 1/2001 Howell et al. ..... 124/88
6,561,477 B1 * 5/2003 Prive ..... 248/339
6,591,825 B1 * 7/2003 Huddleston ..... 124/86

* cited by examiner

*Primary Examiner*—John A. Ricci
(74) *Attorney, Agent, or Firm*—Sturm & Fix LLP

(57) ABSTRACT

An archer must have some strength to both pull a bowstring and hold the archery bow in position. Disclosed is an aid to archers who wish to relieve the arm holding the bow in position. A bow brace extending between the archery bow and the archer transmits the force of the drawn bowstring to the archer's torso instead of to his or her arm. The bow brace is affixed to the archery bow and includes a pad at the end engaging the archer's torso. The bow brace may be removable or foldable for transport and storage.

20 Claims, 4 Drawing Sheets

BRACE FOR HOLDING ARCHERY BOW

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO MICROFICHE APPENDIX

Not Applicable

BACKGROUND OF THE INVENTION

1. Field of the Invention

The present invention relates to equipment for archers and more particularly to a method and apparatus for transmitting the force of bowstring draw to an archer's body.

2. Description of the Related Art

With the advent of compound bows, the strength required for an archer to hold a bow in a drawn position is greatly reduced compared with that needed for a conventional bow. Nonetheless, an archer with an arm or shoulder injury or weakness may still have difficulty drawing and holding the bowstring.

Crossbows are a solution to the above problem, but are not legal for hunting in many states. Most mechanisms providing a way to "cock" the bowstring and hold it steady until released by the archer place the archery equipment in the crossbow category.

Consequently there is a need for a method and apparatus for mitigating the effects of injury or weakness making the holding of an archery bow difficult. There is a further need for an apparatus to hold a bow away from an archers body when drawn that does not place the archery equipment in the crossbow category, thus making it illegal for hunting.

SUMMARY OF THE INVENTION

An object of the present invention is to provide a method and apparatus for permitting an archer having a weakness that reduces their ability to hold and draw a bowstring to use an archery bow. To effect this object, a rigid brace is mounted on the archery bow to extend back to the archer's body and engage the archer's side. The brace may be made to adjust to an archer's arm length. The brace may also be quickly removable or made to fold for ease of transport. The end of the brace engaging the archer is shaped and padded for the comfort of the archer.

In use, a front end of the brace is mounted on the bow near and below the bow's handle. The front mount may be designed to permit the brace to be folded against the bow for storage and transport, while being approximately normal to the bow in use. In addition or alternatively, the bow brace may be made to be easily and quickly removable from the front mount for transport and storage. The bow with the brace in an in-use position is held in the usual shooting position. The padded end of the brace is held against the archer's side under the arm. In this configuration, the archer has only to hold the bow up against gravity and steady for aiming. When the string is drawn as normal, the reaction force is borne by the archer's torso instead of the archers arm, as usual. Significantly less strength is required in the archer's bow-carrying arm than with a conventional apparatus.

Other objects, advantages, and novel features of the present invention will become apparent from the following detailed description of the invention when considered in conjunction with the accompanying drawings.

DETAILED DESCRIPTION OF THE PREFERRED EMBODIMENTS

Figure 1:
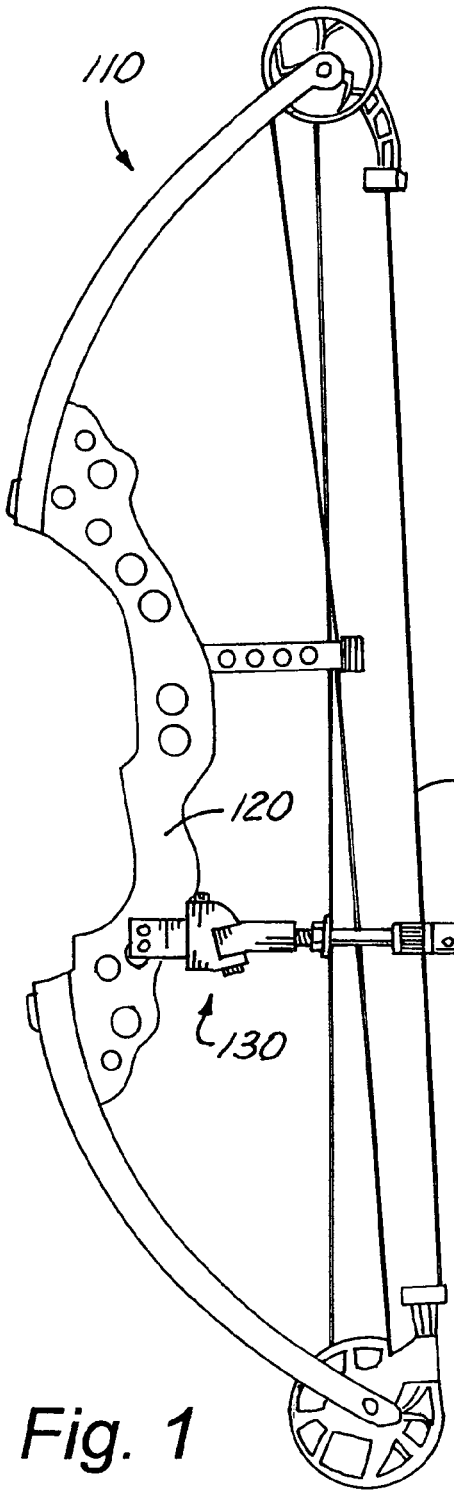
FIG. 1 is a side elevation view of a compound archery bow with the brace of the present invention attached thereto.

Referring now to the drawings wherein like reference numerals designate identical or corresponding parts throughout the several views, FIG. 1 shows a common compound archery bow 110 with an archery bow brace 100 attached thereto. The bow brace 100 is normally affixed to the archery bow 110 below the handle 120 to be in position to engage the archer's side beneath the archer's arm. The mounting hardware 130 in the preferred embodiment permits the bow brace 100 to easily be removed for transport and storage. Another feature of the bow brace 100 is that of noninterference with the bow string 140. To accomplish this aspect, the bow brace 100 should be made with as small a cross-section as will provide the force bearing strength needed. A pad or cushion 150, preferably having a shape to conform to the archer's side, is affixed to the end of the bow brace 100 opposite the archery bow 110.

Figure 2:
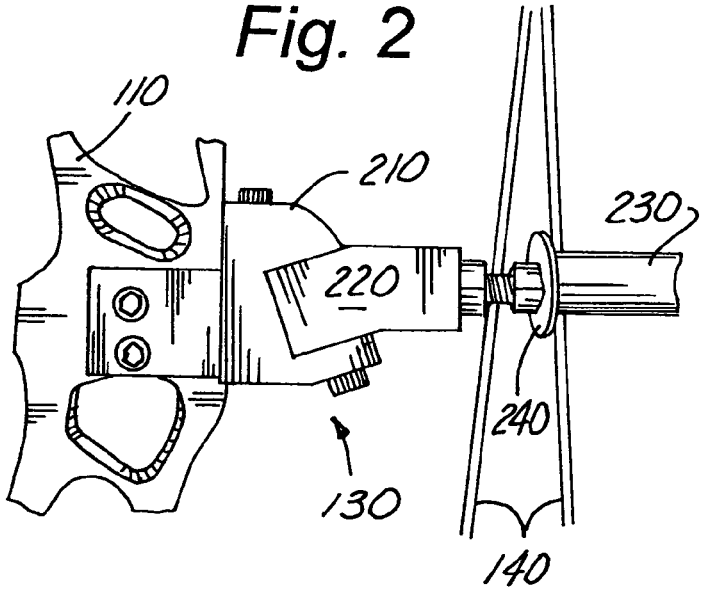
FIG. 2 is a side elevation view of mounting hardware for the archery bow brace.

The hardware 130 for mounting the archery bow brace 100 is shown in detail in FIG. 2. The actual method of affixing the hardware 130 to the archery bow 110 will vary depending on the make and model of the archery bow 110, as is well understood by one of ordinary skill in this art.

In a preferred embodiment, a fixed portion 210 is rigidly affixed to the archery bow 110. A rotatable portion 220 is pivotally affixed to the fixed portion 210, but is made to be tightened to a rigid connection for use. The bow brace 100 is made to slide over a receiver 230 having a stop 240 to limit the amount the bow brace 100 may slide onto the receiver 230. Of course, the receiver 230 may also be a socket and the present invention is not limited to any particular form of the receiver 230.

Figure 3:
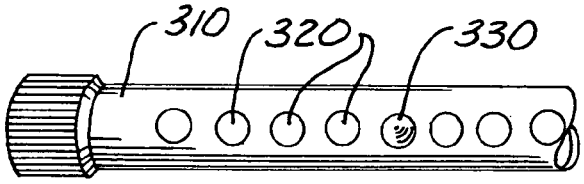
FIG. 3 is a detail of a length adjustment mechanism for the archery bow brace.

In FIG. 3, an outer sleeve 310 of the bow brace 100 is shown. The outer sleeve 310 includes a plurality of adjustment holes 320, any one of which an adjustment button 330 may engage.

Figure 4:
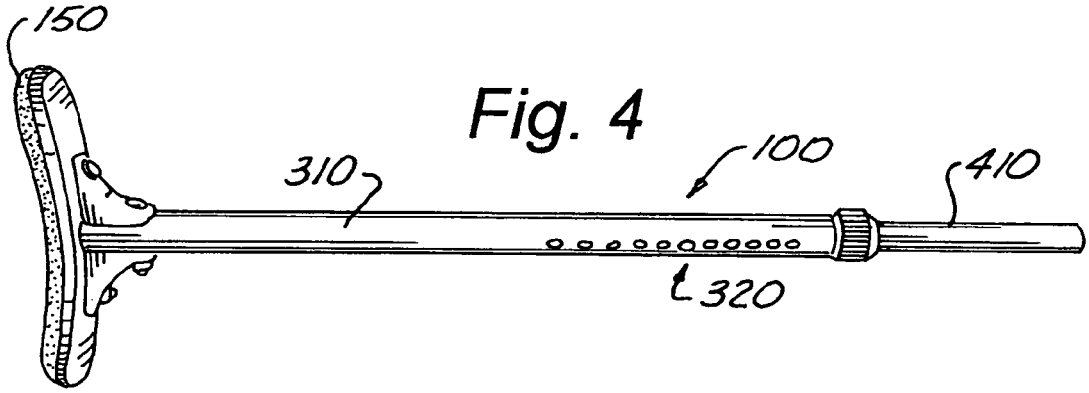
FIG. 4 is a perspective view of the archery bow brace.

A complete bow brace 100, minus the mounting hardware 130 is shown in FIG. 4. An inner section 410 is slidably engaged inside the outer sleeve 310. The combination of the inner section 410, the outer sleeve 310, the plurality of adjustment holes 320 and the adjustment button 330 permits a length of the bow brace 100 to be varied for an archer's arm length and differences in the heaviness of clothing.

Figure 5:
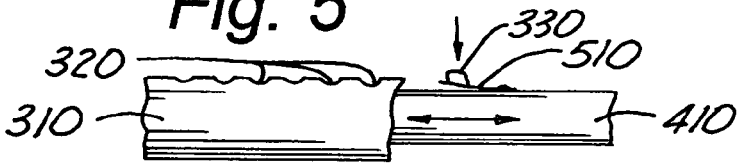
FIG. 5 is a detail of an adjustment button for the archery bow brace.

A detail of the inner section 410, the outer sleeve 310, the plurality of adjustment holes 320 and the adjustment button 330 is shown in FIG. 5. The adjustment button 330 is spring-loaded by a spring 510, as shown. The spring 510 may also take the form of a coil spring or an elastic solid. The present invention is not limited to a particular spring style.

Figure 6:
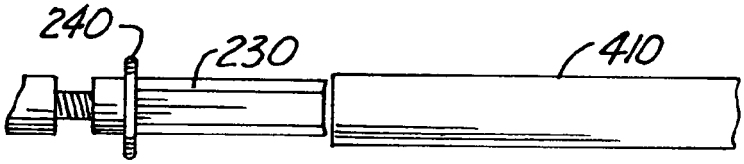
FIG. 6 is a detail of the mounting method of attaching the archery bow brace to the hardware for removably affixing to the archery bow.

The inner section 410 is shown ready to slidably engage the receiver 210 in FIG. 6. In this way, the bow brace 100 may quickly be removed from the archery bow 110 for transport or storage.

Figure 7:
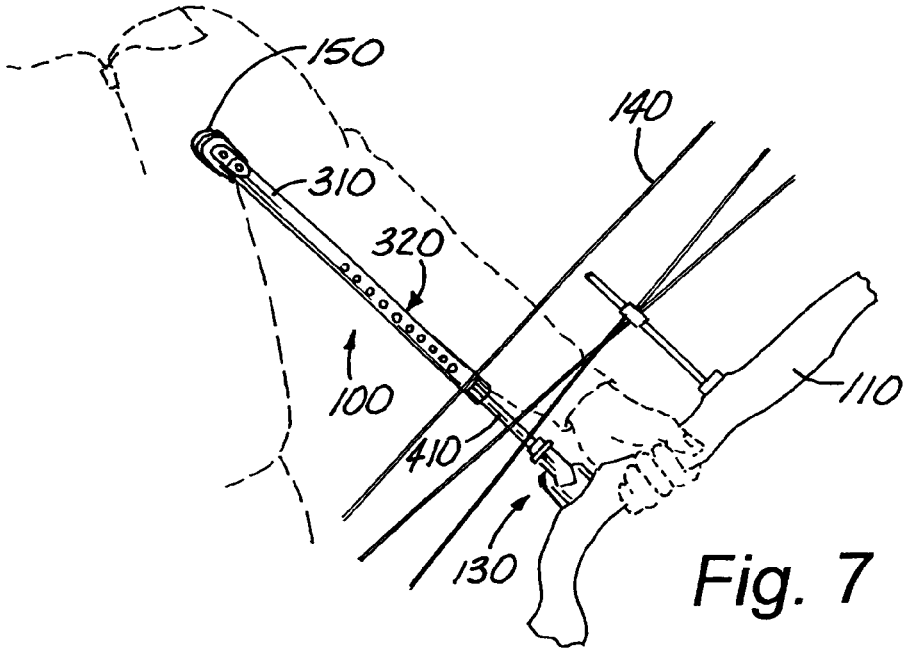
FIG. 7 is a first perspective view of the archery bow brace in use.

The bow brace 100 is shown in an at-ready position in FIG. 7. The bowstring 140 is not drawn, but the bow brace 100 is in position so the archer may draw the bowstring 140 any time. The padded end 150 is placed under the arm to the archer's side in use. When the bowstring 140 is drawn, the bow brace 100 will transmit the reactionary force to the archer's side instead of to the arm used by the archer to hold the bow 110.

Figure 8:
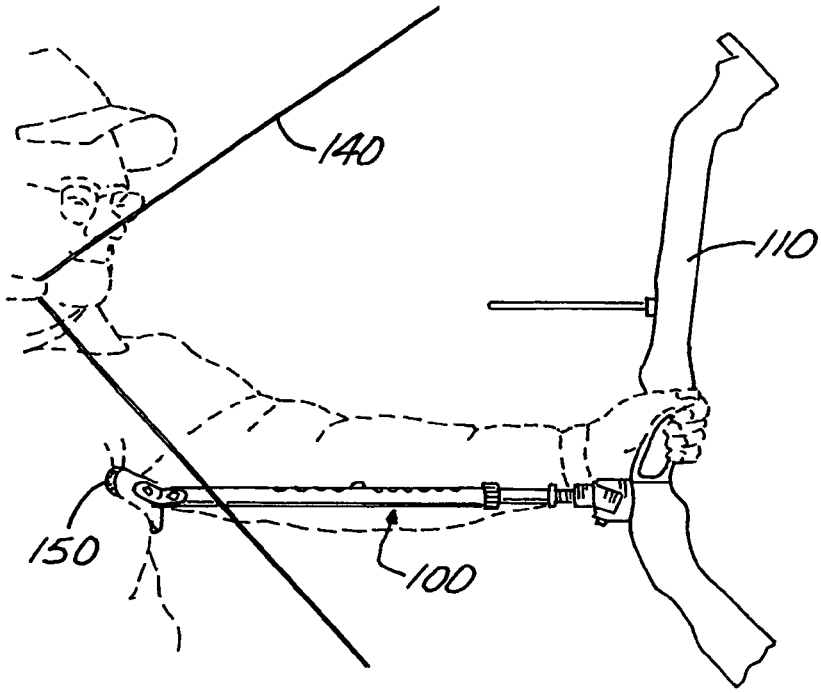
FIG. 8 is a second perspective view of the archery bow brace in use.

From the at-ready position shown in FIG. 7, the bow 110 is raised while the bowstring 140 is drawn. The drawn position is shown in FIG. 8. Here, the bow brace 100 transmits the force produced by the drawn bowstring 140 to the archer's side, thereby relieving the archer's bow arm from undue strain.

Figure 9:
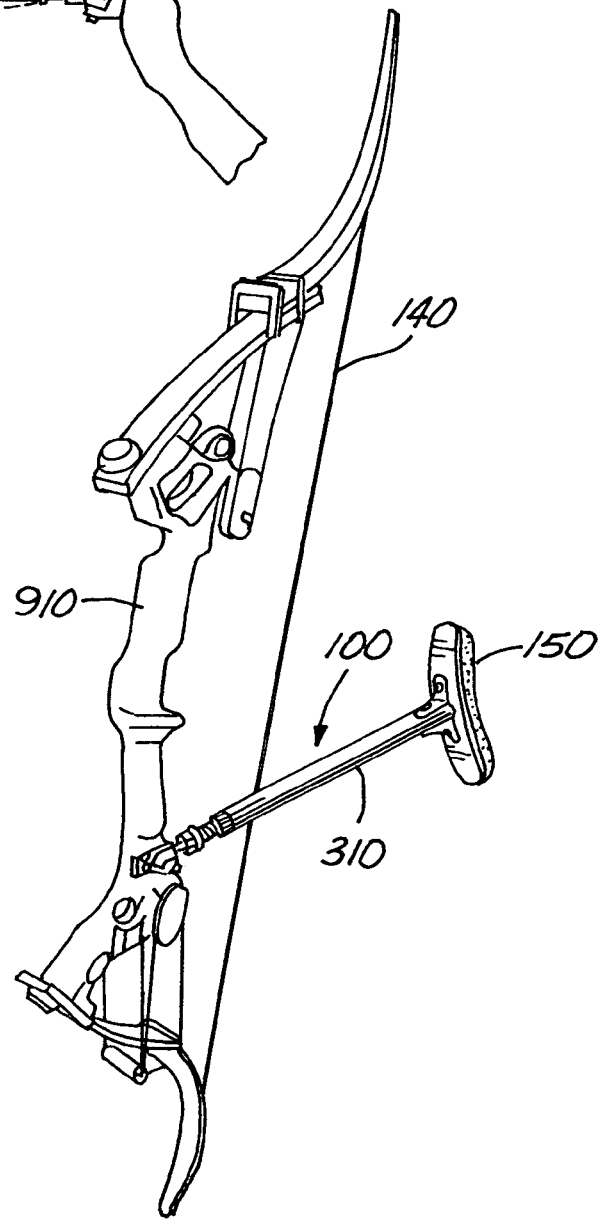
FIG. 9 is a perspective view of the archery bow brace attached to a conventional archery bow.

In FIG. 9, the bow brace 100 is shown affixed to a conventional, (not a compound) bow 910. The present invention is not limited to a particular style of archery bow 110, 910. For the purposes of this specification, a conventional archery bow is defined as any archery bow that is not a compound archery bow.

Figure 10:
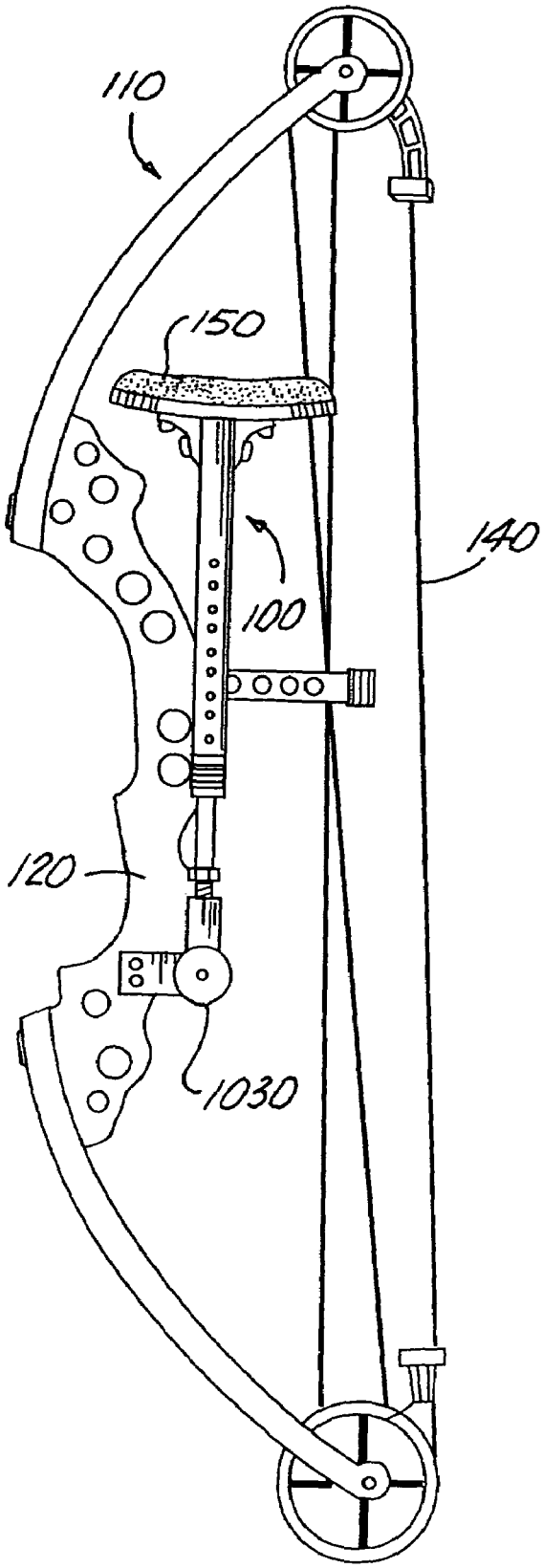
FIG. 10 is a side elevation view of a bow brace folded up for transport or storage.

The bow brace 100 is shown folded against the archery bow 110 in FIG. 10. The mounting hinge 1030 for this embodiment includes a pivot so the bow brace 100 may be positioned for use, as in FIG. 1 or folded for transport as shown in FIG. 10.

Obviously many modifications and variations of the present invention are possible in light of the above teachings. It is therefore to be understood that, within the scope of the appended claims, the invention may be practiced otherwise than as specifically described.

I claim:

1. A method of bracing an archery bow away from an archer's body, the archery bow having an archery bowstring, comprising:

(a) operatively affixing a first end of a bow brace to the archery bow;

(b) operatively engaging a second end of the bow brace to the archer's torso above a hip of the archer; and (c) supporting a reaction force from a drawing of the archery bowstring with the bow brace.

2. The method of claim 1 including operatively, pivotally affixing the first end of the bow brace to the archery bow to facilitate folding the bow brace for storage and transport.

3. The method of claim 1 including operatively, removably affixing the first end of the bow brace to the archery bow to facilitate removal of the bow brace for transport and storage.

4. The method of claim 1 including padding the second end of the bow brace.

5. The method of claim 1 including shaping the second end of the bow brace to conform to the archer's torso above the archer's hip.

6. The method of claim 1 wherein operatively affixing the first end of the bow brace to the archery bow comprises operatively affixing the first end of the bow brace beneath a handle of the archery bow.

7. The method of claim 1 including adjusting a length of the bow brace measured between the archery bow and the archer.

8. The method of claim 1 wherein operatively affixing the first end of the bow brace to the archery bow comprises operatively affixing the first end of the bow brace to a compound archery bow.

9. The method of claim 1 wherein operatively affixing the first end of the bow brace to the archery bow comprises operatively affixing the first end of the bow brace to a conventional archery bow.

10. The method of claim 1 wherein operatively engaging the second end of the bow brace to the archer's torso above the archer's hip comprises operatively engaging the second end of the bow brace to the archer's torso between the archer's underarm and the archer's hip.

11. A bow brace for transmitting a force between an archery bow and an archer, said archery bow having an archery bowstring, said archery bow brace comprising at least one strut extending from the archery bow toward the archer to the torso of the archer above a hip of the archer when the archery bowstring is being drawn, thereby engaging the torso of the archer above the hip of the archer and means for supporting a reactive force between the torso and the archery bow, through the strut, from a drawing of the archery bowstring.

12. The bow brace of claim 11 including hardware for operatively affixing a first end of the at least one strut to the archery bow.

13. The bow brace of claim 12 wherein the hardware for operatively affixing the first end of the at least one strut to the archery bow comprises hardware for operatively, pivotally affixing the first end of the at least one strut to the archery bow such that the bow brace may be folded against the archery bow for transport and storage.

14. The bow brace of claim 12 wherein the hardware for operatively affixing the first end of the at least one strut to the archery bow comprises hardware for operatively, removably affixing the first end of the at least one strut to the archery bow such that the bow brace may be removed from the archery bow for transport and storage.

15. The bow brace of claim 11 including a pad operatively affixed to a second end of the at least one strut for engaging the torso of the archer above the archer's hip.

16. The bow brace of claim 15 wherein the at least one strut is substantially straight from the bow to the pad.

17. The bow brace of claim 11 wherein the at least one strut comprises:

(a) an inner section;

(b) an outer sleeve into which the inner section engages; and (c) an adjustment mechanism for adjusting a length of the at least one strut, said length being measured from the archery bow to the archer.

18. The bow brace of claim 17 wherein the adjustment mechanism comprises:

(a) a plurality of holes in the outer sleeve; and (b) a spring-loaded button operatively affixed to the inner section, said spring loaded button being sized and positioned to engage any of the plurality of holes in the outer sleeve.

19. The bow brace of claim 11 wherein the archery bow to which the bow brace is operatively affixed comprises a compound archery bow.

20. The bow brace of claim 12 wherein the archery bow to which the bow brace is operatively affixed comprises a conventional archery bow.

* * * * *